US009784175B2

(12) United States Patent
Kanefsky et al.

(10) Patent No.: US 9,784,175 B2
(45) Date of Patent: Oct. 10, 2017

(54) INTERNAL COMBUSTION ENGINE AND COOLANT PUMP

(71) Applicant: Ford Global Technologies, LLC, Dearborn, MI (US)

(72) Inventors: Peter Kanefsky, Troy, MI (US); Sunil Katragadda, Canton, MI (US); Ravi Gopal, Novi, MI (US); Clifford E. Maki, New Hudson, MI (US); Lloyd E. Stanley, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 210 days.

(21) Appl. No.: 14/726,759

(22) Filed: Jun. 1, 2015

(65) Prior Publication Data

US 2016/0348568 A1 Dec. 1, 2016

(51) Int. Cl.

| | |
|---|---|
| ***F01P 3/02*** | (2006.01) |
| ***F01P 11/02*** | (2006.01) |
| ***F01P 5/12*** | (2006.01) |
| ***F04D 29/42*** | (2006.01) |
| ***F04D 29/60*** | (2006.01) |

(52) U.S. Cl.

CPC ..... *F01P 11/0285* (2013.01); *F01P 3/02* (2013.01); *F01P 5/12* (2013.01); *F04D 29/426* (2013.01); *F04D 29/605* (2013.01); *F01P 2003/021* (2013.01)

(58) Field of Classification Search

CPC .. F01P 11/0285; F01P 3/02; F01P 5/12; F04D 29/605

See application file for complete search history.

(56) References Cited

U.S. PATENT DOCUMENTS

| | | | | |
|---|---|---|---|---|
| 2,208,057 A * | 7/1940 | Skitch | F04D 29/4273 415/143 |
| 2,296,641 A * | 9/1942 | Hawkins, Jr. | F01P 7/16 123/41.1 |
| 6,745,726 B2 | 6/2004 | Joyce et al. | |
| 8,857,385 B2 | 10/2014 | Beyer et al. | |

FOREIGN PATENT DOCUMENTS

| | | | |
|---|---|---|---|
| GB | 2444271 B | 5/2011 | |
| GB | 2442839 B | 12/2011 | |
| JP | 07243386 A * | 9/1995 | F02B 61/045 |
| JP | 11-148349 * | 6/1999 | |

* cited by examiner

*Primary Examiner* — Kevin A Lathers

(74) *Attorney, Agent, or Firm* — Brooks Kushman P.C.; Greg Brown

(57) ABSTRACT

An engine cylinder block forms a cooling jacket adjacent to a cylinder and that intersects a deck face adapted to mate with a cylinder head. The cooling jacket has an inlet passage intersecting a mounting face adapted to mate with a coolant pump housing. The block forms a vent passage extending from the cooling jacket to the mounting face. The pump housing forms a volute adapted to receive an impeller. The housing forms a discharge passage that fluidly connects to the inlet passage of the block. The pump housing also forms a vent passage the fluidly connects with the vent passage of the block. The vent passages of the block and pump housing are positioned between the deck face of the block and the inlet and discharge passages when the pump housing is connected to the engine block.

20 Claims, 3 Drawing Sheets

INTERNAL COMBUSTION ENGINE AND COOLANT PUMP

TECHNICAL FIELD

Various embodiments relate to an internal combustion engine and a vent or degas line for a coolant pump for the engine.

BACKGROUND

Internal combustion engines often include cooling systems that provide coolant flow through passages formed in the engine block. The cooling system has a pump to drive coolant flow through the system, and the pump is often mechanically driven by the crankshaft or other rotating component of the engine. The pump used with the cooling system may be a centrifugal pump, which is designed to pump liquids and not gases or vapors. The pump chamber, or volute, needs to be filled or substantially filled with liquid for the pump to operate.

Priming is the act of replacing the air or gas inside the pump volute with coolant, such as liquid water. Often, the pump needs to be primed when it is installed and coolant is first introduced into the cooling system. The pump may also need to be primed at each cold start of the engine as the coolant may drain from the pump volute when the engine is not operating. Generally, centrifugal pumps need to be primed and cannot produce a reduced pressure on the suction side without the presence of liquid inside the volute, or they operate at a reduced pumping efficiency. If the pump chamber contains entrained air or gas, the pump may lose its prime, for example, with the accumulation of air in the eye of the impeller which would block liquid flow through the pump. The performance effect on the pump due to entrained air may vary depending on many variables, including pump operating speed, impeller design, number of vanes, operating point on the curve, suction pressure, etc. Operating the pump for an extended period with entrained air may also cause the pump to operate at a temperature above its normal operating temperature range, and may cause wear or stress on pump surfaces and components. Often the pump is positioned with the discharge port at the high point of the volute to provide venting of gases within the volute.

SUMMARY

According to an embodiment, an engine is provided with a cylinder block. The block forms a cooling jacket adjacent to a cylinder that intersects a deck face adapted to mate with a cylinder head. The cooling jacket has an inlet passage intersecting a mounting face adapted to mate with a coolant pump housing. The block forms a vent passage extending from the cooling jacket to the mounting face. The vent passage is positioned between the inlet passage and the deck face.

According to another embodiment, an engine cooling system is provided with a pump housing forming a volute adapted to receive an impeller. The housing forms a discharge passage extending between the volute and a mounting face adapted to connect to an engine block. The housing also forms a vent passage extending between the volute and the mounting face. The vent passage is positioned between a deck face and the discharge passage when the housing is connected to an engine block.

According to yet another embodiment, a method for cooling an engine is provided. An impeller of a pump mounted to a cylinder block is rotated. The impeller is positioned between a block deck face and a pump discharge passage fluidly connected to a cooling passage in the cylinder block. A volute of the pump is primed using a vent passage fluidly connecting the cooling passage and the volute, the vent passage positioned between the impeller and the deck face.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
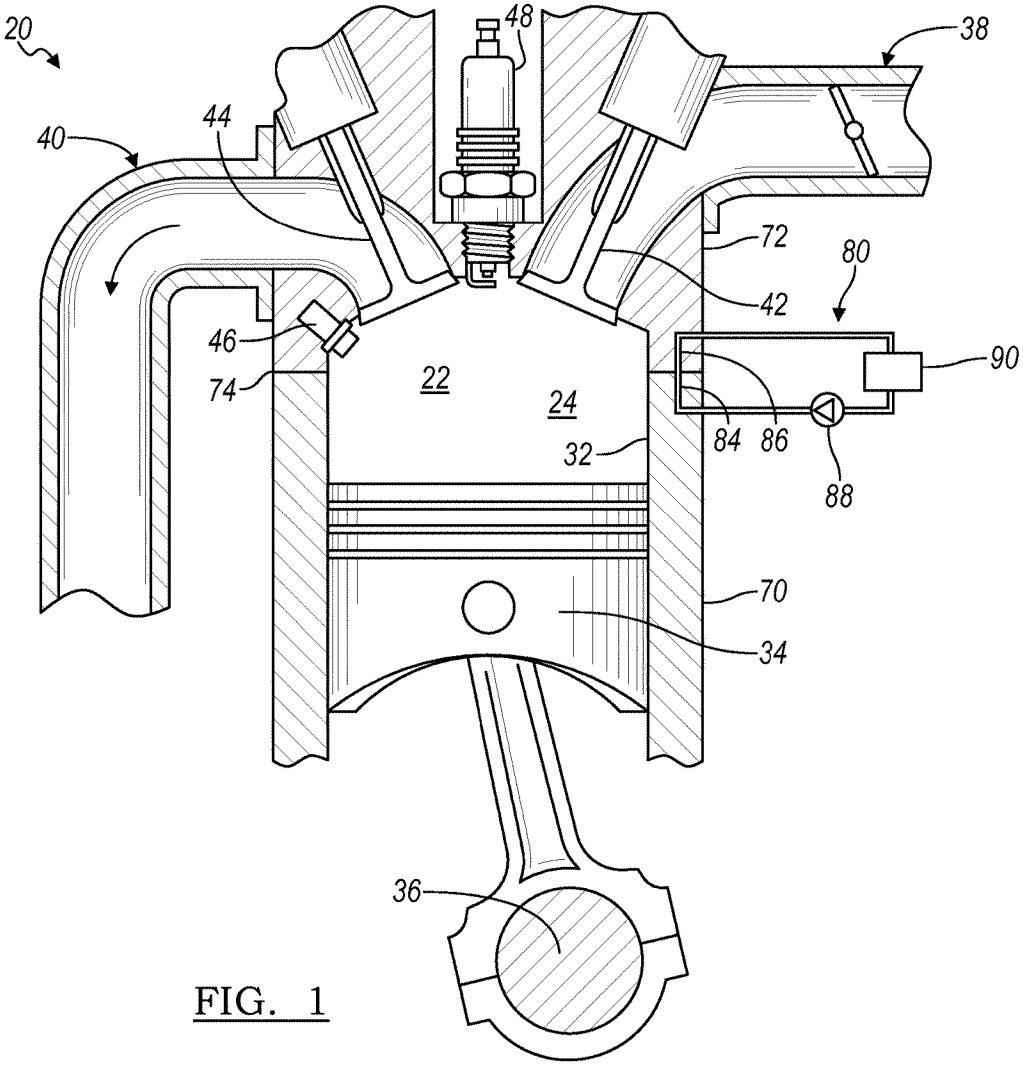
FIG. 1 illustrates a schematic of an internal combustion engine configured to implement various embodiments according to the present disclosure.

FIG. 1 illustrates a schematic of an internal combustion engine 20. The engine 20 has a plurality of cylinders 22, and one cylinder is illustrated. The engine 20 may have any number of cylinders, and the cylinders may be arranged in various configurations. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust manifold 40. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, the exhaust system, and the like. Engine sensors may include, but are not limited to, an oxygen sensor in the exhaust manifold 40, an engine coolant temperature sensor, an accelerator pedal position sensor, an engine manifold pressure (MAP) sensor, an engine position sensor for crankshaft position, an air mass sensor in the intake manifold 38, a throttle position sensor, an exhaust gas temperature sensor in the exhaust manifold 40, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an after treatment system such as a catalytic converter.

The intake and exhaust valve 42, 44 positions and timing, as well as the fuel injection timing and ignition timing may be varied for the various engine strokes.

The engine 20 has a cylinder block 70 and a cylinder head 72 that cooperate with one another to form the combustion chambers 24. A head gasket (not shown) may be positioned between the block 70 and the head 72 to seal the chamber 24. The cylinder block 70 has a block deck face that corresponds with and mates with a head deck face of the cylinder head 72 along part line 74.

The engine 20 includes a fluid system 80. In one example, the fluid system is a cooling system to remove heat from the engine 20. In another example, the fluid system 80 is a lubrication system to lubricate engine components.

For a cooling system 80, the amount of heat removed from the engine 20 may be controlled by a cooling system controller or the engine controller. The system 80 may be integrated into the engine 20 as one or more cooling jackets. The system 80 has one or more cooling circuits that may contain water or another coolant as the working fluid. In one example, the cooling circuit has a first cooling jacket 84 in the cylinder block 70 and a second cooling jacket 86 in the cylinder head 72 with the jackets 84, 86 in fluid communication with each other. The block 70 and the head 72 may have additional cooling jackets. Coolant, such as water, in the cooling circuit 80 and jackets 84, 86 flows from an area of high pressure towards an area of lower pressure.

The fluid system 80 has one or more pumps 88. In a cooling system 80, the pump 88 provides fluid in the circuit to fluid passages in the cylinder block 70 and to the head 72. The cooling system 80 may be a parallel flow, split flow, parallel-split flow, or other cooling arrangement. The cooling system 80 may also include valves (not shown) to control the flow or pressure of coolant, or direct coolant within the system 80. The cooling passages in the cylinder block 70 may be adjacent to one or more of the combustion chambers 24 and cylinders 22. Similarly, the cooling passages in the cylinder head 72 may be adjacent to one or more of the combustion chambers 24 and cylinders 22, and the exhaust ports for the exhaust valves 44. Fluid flows from the cylinder head 72 and out of the engine 20 to a heat exchanger 90 such as a radiator where heat is transferred from the coolant to the environment.

Figure 2:
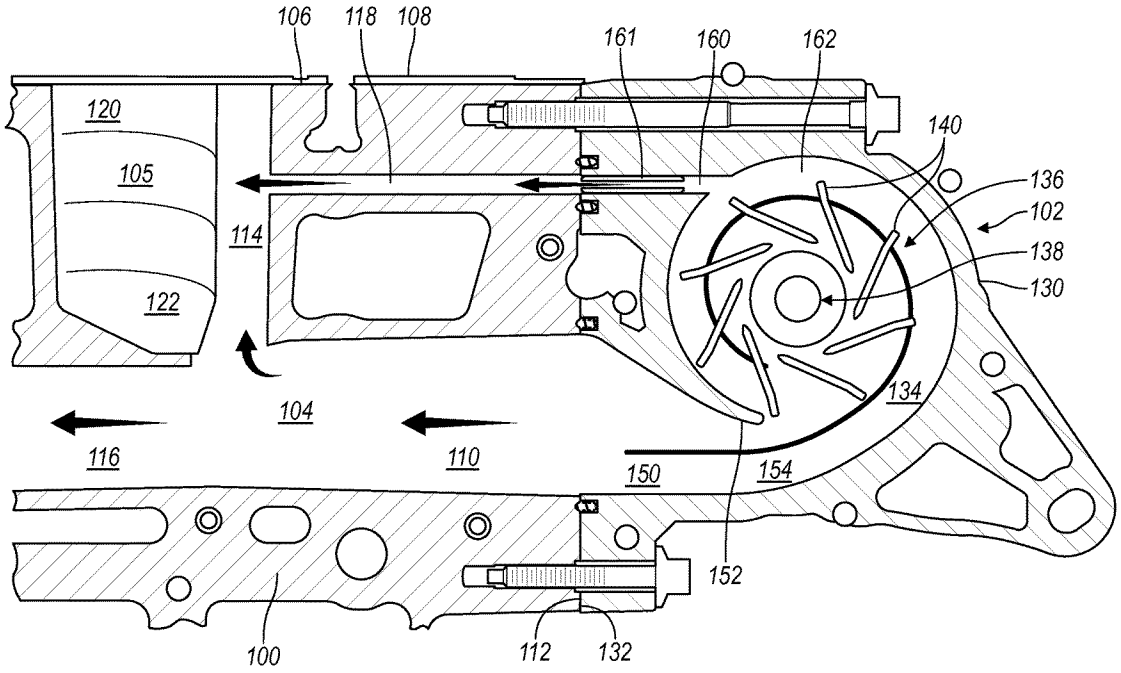
FIG. 2 illustrates a partial cross sectional view of an engine block and cooling pump according to an embodiment.

FIG. 2 illustrates a partial sectional view of an engine and cooling system. A portion of the engine block 100 is shown, as well as a pump 102 for the engine cooling system.

The engine block 100 or cylinder block forms a cooling jacket 104. The cooling jacket 104 or fluid jacket includes passages formed within the block 100 for coolant to flow through. The cooling system and jacket 104 may contain water or another liquid for use in thermal management of the engine. The cooling passages in the jacket 104 include passages that are adjacent to or in contact with one or more cylinders or cylinder liners of the block. In one example, the block 100 is an open deck configuration, and the cooling passage generally surrounds the cylinders or cylinder liners. In one example, the engine block has cylinders arranged in an inline configuration, and in a further example, the cylinders are siamesed such that an interbore region or structure is formed between adjacent cylinders. In this example, the cooling passage of the jacket surrounds the cylinder liners, and may additionally have passages providing coolant flow in the interbore regions. A portion of a cylinder liner 105 is shown in the Figure.

The block 100 has a deck face 106 that is configured to mate with a cylinder head. A head gasket 108 may be provided between the deck face 106 of the block and the head to seal the combustion chambers.

The fluid jacket 104 is illustrated as a parallel split flow configuration, although other configurations are also contemplated. Coolant enters the engine and the cooling jacket 104 at an inlet passage 110. The inlet passage 110 intersects a mounting face 112 of the block 100. The mounting face 112 is configured to connect to the pump 102, as described in greater detail below. The mounting face 112 may be provided on a side of the engine block 100 and is adjacent to and at an angle with respect to the deck face 106. In one example, the mounting face 112 is approximately ninety degrees relative to the deck face 106.

The inlet passage 110 fluidly connects and provides coolant to one or more fluid passages 114 in the block 100. In the example shown, the fluid passage 114 is adjacent to or in fluid contact with one or more cylinders or cylinder liners of the engine. The inlet passage 110 may also provide coolant that is directed to the cylinder head through passage 116. Coolant may additionally flow from passage 114, through holes in the gasket 108, and into the cylinder head. The coolant flows through the block and the head, and then exits the block and/or head, and is directed back to the pump 102. Additional components may be included such as coolers, radiators, filters, valves, thermostats, sensors, and the like.

The block 100 also forms a vent passage 118 that extends between the cooling passage 114 in the jacket 104 and the mounting face 112. The vent passage 118 is positioned between the inlet passage 110 and the deck face 106.

The cylinder or cylinder liners 105 in the block 100 each have a first end region 120 and a second end region 122. The first end region 120 is adjacent to the deck face 106. The second end region is opposed to the first end region and is spaced apart from the deck face 106. When an engine is in use, the first end region 120 of the cylinder 105 is vertically above or at a higher elevation than the second end region 122. The inlet passage 110 fluidly connects to the cooling passage 114 at the second opposed end region 122 of the at least one cylinder 105. The vent passage 118 of the block fluidly connects to the cooling passage 114 between the first end region 120 and the opposed end region 122 of the at least one cylinder 105, or fluidly connects to the cooling passage 114 at the first end region 120. The vent passage 118 has a smaller cross sectional area than the inlet passage 110.

The pump 102 is connected to the block 100 at the mounting face 112 of the block 100. The pump 102 has a pump housing 130. The pump housing 130 has a mounting face 132 that is configured to mate with the mounting face 112 of the block 100. Fasteners such as bolts or the like may be used to connect the pump 102 to the block 100. Sealing members, such as gaskets, O-rings, and the like may also be provided between the mounting faces 112, 132.

The pump 102 is a centrifugal pump. In one example, as shown, the pump is a single stage centrifugal pump. In other examples, the pump may be a two stage centrifugal pump.

The pump housing 130 forms a pump chamber or volute 134. An impeller 136 is supported for rotation within the volute 134. The impeller 136 has an eye 138 and a series of vanes 140. The pump 102 may be mechanically driven, and in the present example, the impeller 136 is mechanically connected to the crankshaft of the engine, such that the impeller is driven by the crankshaft. The pump may be mechanically connected to the crankshaft via a belt mechanism that includes pulleys or gears in sized selected based on a desired range of operation for pump speeds.

The eye 138 provides a suction inlet to the pump 102. Fluid flows into the pump 102 though the eye 138 of the impeller 136. In the present example, the coolant flows through the eye 138 in a direction out of the page. The impeller 136 has a series of vanes 140. The impeller 136 may be an open, semi-open, or closed impeller design with the vanes fitted on shroud plates or the like. The vanes may 140 may be extend radially outward, backward, or forwards, and the vanes may be straight or curved. As the impeller 136 is rotated or driven, the fluid in the volute 134 or pump chamber surrounding the impeller also rotates. The impeller 136 forces the coolant to move radially outwards in the volute 134.

The coolant flows out of the volute 134 via a discharge passage 150. A cutwater 152 may be provided at an entrance region 154 to the discharge passage 150. The volute 134 and the pump housing have an increasing area along the flow direction or the rotational direction of the impeller 136. This increased area acts to increase the pressure at the discharge region of the pump as the area is increasing and the velocity is decreasing. As the pressure is increased at the discharge passage 150, the water at the eye 138 is being displaced, which causes a suction effect to draw fluid into the volute 134.

The cutwater 152 acts to provide a portion of the channel or discharge passage 150 for fluid in the pump 102. The impeller 136 is illustrated as being offcenter in the volute 134 or pump chamber such that there is a reduced clearance between the vanes 140 of the impeller 136 at the cutwater 152 and immediately downstream than there is between the impeller 136 and the rest of the volute 134. The clearance or spacing between the impeller 136 and the volute 134 walls increases from the from the cutwater 152, around the casing, to the discharge 154, which provides the increased area to develop a pressure head.

The discharge passage 150 extends from the volute 134 to the mounting face 132 of the housing, and fluidly connects with the inlet passage 110 of the block 100.

The housing 130 also forms a vent passage 160 that extends between the volute 134 and the mounting face 132 of the pump 102. The vent passage 160 fluidly connects with the vent passage 118 of the block 100.

A flow restrictor 161, such as a sleeve or liner, may be provided in one or both of the vent passages 118, 160 to restrict coolant flow therethrough. In the present example, the restrictor 161 is illustrated as a sleeve in the pump housing vent passage 160. The flow restrictor 161 acts to reduce the cross sectional area of the passage 118, 160, and may be sized or selected based on flow and cooling characteristics of the cooling system.

The vent passage 160 fluidly connects to the volute 134 at or adjacent to a high point 162 in the volute 134 and pump housing 130. The high point 162 may be generally opposed to the entrance 154 to the discharge port 150.

In the example shown, the vent passage 160 intersects the volute at a location that is an angle of approximately ninety degrees from the cutwater 152 where the angle is taken about the rotational axis of the impeller 136, or in other words, approximately ninety degrees of impeller rotation downstream. In other examples, the vent passage 160 may be located at an angle that is greater or less than ninety degrees, and may be in the range of 45 degrees to 120 degrees apart from the cutwater 152. The location of the vent passage 160 is based partially on the high point 162 of the volute 134, and also based on the distance downstream of the cutwater 152. The impeller 136 rotates clockwise in the present example, such that the vent passage 160 is located downstream of the cutwater 152. If the vent passage 160 is located too far downstream, issues with impeller cavitation or other flow disruption may occur as the fluid has a higher pressure the closer it is to the entrance 154 to the discharge passage 150 and the cutwater 152.

The eye 138 of the impeller 136 is positioned between a plane defines by the deck face 106 and the discharge passage 150 or the entrance to the discharge passage of the pump 102. The vent passage 160 intersects the volute 134 between the high point 162 and the cutwater 152. The vent passage 160 intersects the volute 134 between the eye 138 and the high point 162, or between the eye 138 and the plane defining the deck face 106.

The pump 102 connection is unusual in that the discharge port 150 is positioned at the low point of the pump 102, or is generally opposed to the high point 162 and the deck face 106. In conventional engine cooling pumps, the discharge port is typically positioned to substantially coincide with the high point of the pump to provide for priming.

In the present example, the pump 102 is connected to the block 100 when the engine is assembled. After the coolant system connections are made, a liquid coolant is added to the system. The coolant may be added at various locations in the system, and is often added via a port provided on or adjacent to the radiator, which acts as a high point for the coolant system. As the liquid coolant flows into the system, air may be trapped in localized high points, such as in the volute 134. Coolant flows into the pump housing 102 through the vent line 118, 160 and/or the inlet and discharge passages 110, 150. The vent line 118, 160 allows for any trapped air or vapor in the volute 134 to exit the pump housing 130, and primes the pump 102. Any air exits the volute 134 through the vent lines 160, 118, flows into the cooling passage 114, and then likely up into cooling passages in the head, and to a system degas bottle or vent. If no vent line 118, 160 is provided to the volute 134, the pump chamber would likely contain a significant air pocket, and the pump 102 may not prime.

During operation, the engine operates to drive the crankshaft, which in turn rotates the impeller of the pump and creates a suction force drawing fluid through the eye 138. The fluid is compressed by the vanes of the impeller, and is directed to the discharge port 150. The pump circulates coolant through the engine block, engine, and cooling system, and the coolant eventually returns to the pump inlet and the eye 138.

When the engine is shut down, the crankshaft stops rotating and the impeller is no longer driven. While the engine and pump are at rest, the coolant is no longer flowing through the system, and the volute may contain air. The vent line provides acts as a degas line for any air or vapor in the volute 134 to maintain the prime in the pump 102.

Various embodiments of the present disclosure have associated, non-limiting advantages. For example, the pump degas vent passage 118, 160 was integrated into the cylinder block 100 and water pump volute 134. The vent passage 118, 160 is plumbed internal to the cylinder block 100 instead of a more conventional external plumbing to a degas bottle or the like due to high pressures associated with the discharge side of the pump volute 134. A degas or vent feature needs to be placed on the high pressure side of the water pump volute 134 to overcome and degas trapped gases in the volute 134, such that external plumbing to an external degas bottle is not a desirable configuration based on the pressures involved. The vent passages 118, 160 prevent the pump from having priming issues during start up and provide air venting to the cooling passages 114 and jacket 104 of the block 100 during engine start up conditions. By configuring the degas vent passages 118, 160 as internal integrated passages, the passages 118, 160 continue to function under the maximum pressure produced by the pump 102 without failure to the entire degas system of the engine. Additionally, as the vent passage 118, 160 is at a higher coolant pressure during pump operation compared to a conventional degas bottle connection, pump 102 efficiencies may be increased. The vent passages 118, 160 also reduce potential coolant leaks due to the single plane direct mounting of the pump 102 to the block 100 at mounting planes 112, 132.

Figure 3:
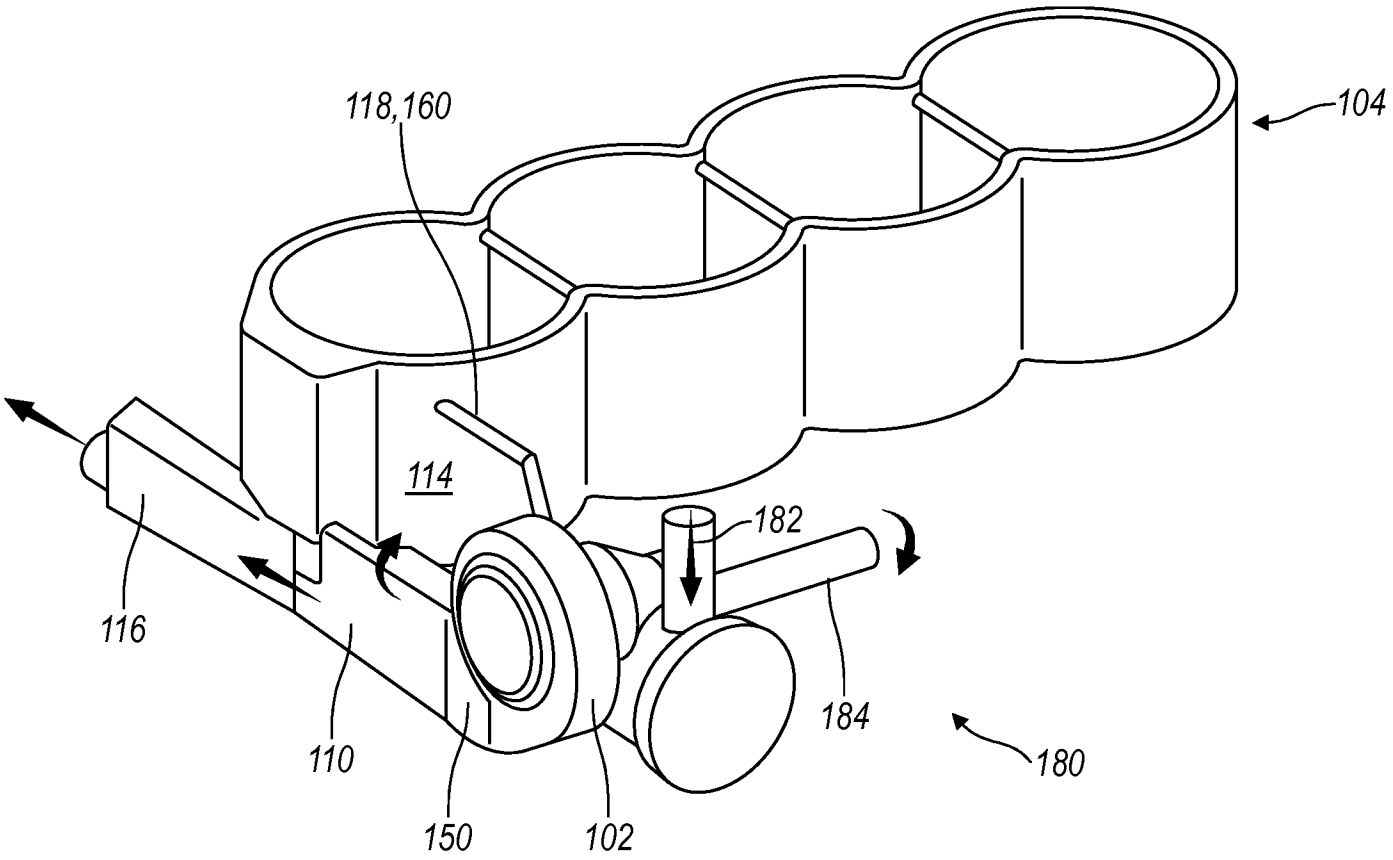
FIG. 3 illustrates a partial schematic of a cooling system including the engine block and cooling pump of FIG. 2.

FIG. 3 illustrates a partial schematic of a cooling system 180 for an engine. Note that negative space for the fluid passages is illustrated, and that the structure of the surrounding engine block or portions of the pump housing are omitted for clarity. The pump 102 receives liquid coolant through an inlet 182. The impeller 136 of the pump 102 is rotated by a shaft 184 that is mechanically linked to or driven by the crankshaft. Pressurized coolant exits the pump through the discharge passage 150 and flows into the inlet passage 110 of the fluid jacket 104 of the engine block. The fluid jacket 104 of the engine block is schematically illustrated in FIG. 3. A portion of the coolant flows to the cylinder head through passage 116. Another portion of the coolant is directed to cooling passages 114 surrounding at least one cylinder in the engine block. The vent passage 118, 160 fluidly connects the passage 114 to the pump 102.

Coolant flows though the head, the block, and various other cooling system components and returns to the pump inlet at 182.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An engine comprising:

a cylinder block, the block forming a cooling jacket adjacent to a cylinder and intersecting a deck face adapted to mate with a cylinder head, the cooling jacket having an inlet passage intersecting a blockside mounting face, the block forming a vent passage extending from the cooling jacket to the blockside mounting face, the vent passage positioned between the inlet passage and the deck face; and a coolant pump having an impeller driven within a coolant pump housing, the coolant pump housing forming a volute and a discharge passage, the pump housing forming a pump mounting face adapted to mate with the blockside mounting face to fluidly connect the discharge passage of the pump to the inlet passage of the jacket, the pump housing forming a vent passage extending between the pump mounting face and the volute, the vent passage of the pump positioned to fluidly connect with the vent passage of the block.

2. The engine of claim 1 wherein an eye of the impeller provides a suction inlet to the pump.

3. The engine of claim 2 wherein the eye of the impeller is positioned between the discharge passage of the pump and a plane defined by the deck face of the block.

4. The engine of claim 1 wherein the impeller is driven by a crankshaft of the engine.

5. The engine of claim 1 further comprising a flow restrictor positioned in one of the vent passage of the block and the vent passage of the pump.

6. The engine of claim 1 wherein the volute has a cutwater at the discharge passage, wherein the vent passage of the pump is spaced apart from the cutwater about the volute by an angle between 45 degrees and 120 degrees.

7. The engine of claim 1 wherein the volute has a cutwater at the discharge passage, wherein the vent passage of the pump is spaced apart from the cutwater about the volute by an angle of ninety degrees.

8. The engine of claim 1 wherein the volute has a cutwater at an entrance to the discharge passage, wherein the vent passage of the pump intersects the volute between a high point in the volute and the cutwater.

9. The engine of claim 1 wherein the blockside mounting face is on a side of the block and is adjacent to the deck face.

10. The engine of claim 1 wherein the jacket forms a cooling passage surrounding at least one cylinder.

11. The engine of claim 10 wherein the at least one cylinder has a first end region adjacent to the deck face and an opposed end region; and wherein the inlet passage to the jacket fluidly connects to the cooling passage at the opposed end region of the at least one cylinder.

12. The engine of claim 11 wherein the vent passage of the block fluidly connects to the cooling passage between the first end region and the opposed end region of the at least one cylinder.

13. The engine of claim 10 wherein the cooling passage surrounds a plurality of cylinders arranged in a siamesed configuration.

14. An engine cooling system comprising:

a pump having a pump housing forming a volute receiving an impeller, the housing forming a discharge passage extending between the volute and a mounting face adapted to connect to an engine block, the housing forming a vent passage extending between the volute and the mounting face, the vent passage positioned between an engine block deck face and the discharge passage when the housing is connected to the engine block.

15. The engine cooling system of claim 14 wherein the housing forms a cutwater in the volute at an entrance region to the discharge passage; and wherein the vent passage is spaced apart from the cutwater about the volute by ninety degrees of impeller rotation.

16. The engine cooling system of claim 14 wherein the housing forms a cutwater in the volute at an entrance region to the discharge passage;

wherein a high point in the volute is generally opposed to the entrance to the discharge passage; and wherein the vent passage is adjacent to the high point.

17. The engine cooling system of claim 14, further comprising a cylinder block forming a cooling jacket substantially surrounding at least one cylinder, the jacket having an inlet passage fluidly connected to the discharge passage of the pump housing, and a vent passage of the block fluidly connected to the vent passage of the pump housing, the inlet passage and the vent passage of the jacket intersecting a pump mounting face of the block, the vent passage of the block positioned between the inlet passage and the engine block deck face.

18. A method for cooling an engine comprising:

rotating an impeller of a pump mounted to a cylinder block, the impeller positioned between a block deck face and a pump discharge passage fluidly connected to a cooling passage in the cylinder block; and priming a volute of the pump using a vent passage fluidly connecting the cooling passage and the volute, the vent passage positioned between the impeller and the deck face.

19. The method of claim 18 wherein priming the volute of the pump includes filling the volute with coolant from the cooling passage via at least one of the vent passage and the discharge passage, and degassing the volute with vapor via vapor exiting the volute to the cooling passage via the vent passage.

20. The method of claim 18 further comprising inserting a flow restrictor into the vent passage to control fluid flow therethrough.

* * * * *